US007043906B2

(12) United States Patent
Suzuki et al.

(10) Patent No.: US 7,043,906 B2
(45) Date of Patent: May 16, 2006

(54) HYDRAULIC EQUIPMENT

(75) Inventors: Shigeru Suzuki, Tokyo (JP); Kouichi Aoyama, Tokyo (JP); Satoru Shimada, Tokyo (JP); Sumiko Seki, Yokohama (JP); Takahiko Itoh, Yokohama (JP)

(73) Assignees: Saxa Inc., Tokyo (JP); Yukigawa Institute Co., Ltd., Kanagawa (JP)

( * ) Notice: Subject to any disclaimer, the term of this patent is extended or adjusted under 35 U.S.C. 154(b) by 9 days.

(21) Appl. No.: 10/492,978

(22) PCT Filed: Oct. 18, 2002

(86) PCT No.: PCT/JP02/10849

§ 371 (c)(1),
(2), (4) Date: Oct. 12, 2004

(87) PCT Pub. No.: WO03/036100

PCT Pub. Date: May 1, 2003

(65) Prior Publication Data

US 2005/0042121 A1 Feb. 24, 2005

(30) Foreign Application Priority Data

Oct. 19, 2001 (JP) ..... 2001-356727

(51) Int. Cl.
*F15B 11/02* (2006.01)

(52) U.S. Cl. ..... 60/422; 60/459; 60/464

(58) Field of Classification Search ..... 60/413, 60/422, 459, 464, 494; 417/440
See application file for complete search history.

(56) References Cited

U.S. PATENT DOCUMENTS

| | | | | |
|---|---|---|---|---|
| 5,733,095 | A | 3/1998 | Palmer et al. | 414/685 |
| 6,178,803 | B1 | 1/2001 | Ozaki et al. | |
| 6,467,264 | B1 * | 10/2002 | Stephenson et al. | 60/494 |

FOREIGN PATENT DOCUMENTS

| | | | |
|---|---|---|---|
| EP | 0 558 765 | A1 | 9/1993 |
| JP | 51-60876 | A | 5/1976 |
| JP | 52-119777 | A | 10/1977 |
| JP | 55-35773 | A | 3/1980 |
| JP | 1-303302 | | 12/1989 |
| JP | 9-72313 | A | 3/1997 |
| JP | 9-88906 | A | 3/1997 |

* cited by examiner

*Primary Examiner*—Thomas E. Lazo
(74) *Attorney, Agent, or Firm*—Morgan, Lewis & Bockius LLP

(57) ABSTRACT

A hydraulic apparatus realizes the same function as that of a variable discharge pump by regulating a hydraulic device such as a control valve in a state always operated at a substantially constant number of revolutions with a high efficiency regardless of the type of a hydraulic pump driven by a driving source such as a heat engine or electric motor. This hydraulic apparatus drives a hydraulic pump with a driving source internally or additionally provided with a predetermined amount of inertia, so as to construct a fixed pressure hydraulic source, and further provides peripheral devices corresponding to a required load, so as to open/close a control valve according to a state of a load including an energy accumulating device, a hydraulic motor, or the like such that the load can be supplied with an operating fluid ranging from a low flow rate at a high pressure to a high flow rate at a low pressure.

13 Claims, 4 Drawing Sheets

F W
D W
M
P
A
B
T

HYDRAULIC EQUIPMENT

TECHNICAL FIELD

The present invention relates to a hydraulic apparatus and, more particularly, relates to a hydraulic apparatus comprising a hydraulic pump driven by a driving source having a predetermined amount of inertia or a predetermined amount of moment of inertia, and a load driven by a hydraulic pressure generated by the hydraulic pump.

BACKGROUND ART

In a hydraulic apparatus in which a load such as a hydraulic motor is driven by a hydraulic pressure generated by a hydraulic pump of fixed discharge amount type, for example, the amount of operating fluid discharged from the hydraulic pump is fixed. Therefore, when the amount of operating fluid needed by the load fluctuates, an excess of operating fluid occurs. Therefore, means for changing the number of revolutions of the hydraulic pump and means for adjusting the flow rate by flow rate adjusting means such as a throttle valve or reducing valve have been employed in general in order to supply an amount of operating fluid required by the load.

However, each of the hydraulic pump and the driving source such as a heat engine or electric motor for driving the hydraulic pump is hard to keep a high efficiency in all the revolution ranges, whereby the efficiency in the hydraulic apparatus may deteriorate when the hydraulic pump changes its number of revolutions. Also, the flow rate adjustment consumes the hydraulic energy as thermal energy, which may lower the efficiency in the hydraulic apparatus.

Hydraulic apparatus using a variable discharge type pump for supplying a necessary amount of operating fluid to the load have also been known. However, such a pump has a complicated structure and is expensive.

Therefore, it is an object of the present invention to provide a hydraulic apparatus which can efficiently supply a load with an operating fluid within the range from a low flow rate to a high flow rate while keeping a substantially fixed amount of discharge from a hydraulic pump.

DISCLOSURE OF THE INVENTION

For achieving the above-mentioned object, the present invention provides a hydraulic apparatus comprising a driving source inherently or additionally provided with a predetermined amount of inertia, a hydraulic pump driven by the driving source, a first control valve connected to a discharge side of the hydraulic pump, a flow path guiding a pass side of the first control valve to an operating fluid tank, and a check valve having an input side directed to the discharge side of the hydraulic pump; wherein, when the first control valve is switched from the pass side to a stop side, an operating fluid whose pressure is raised by the inertia is supplied to a load connected to an output side of the check valve. It will be effective if the switching operation is carried out repeatedly.

In the hydraulic apparatus in accordance with the present invention, the first control valve is switched to the pass side when the hydraulic pump attains a load torque reaching a value exceeding an output torque of the driving source and a number of revolutions lowered to a lower limit, and is switched to the stop side after the number of revolutions of the hydraulic pump increases to an upper limit as the load torque of the hydraulic pump decreases. Preferably, the switching operation is carried out according to a value of detecting means for detecting a state of a driving system or load system connected thereto, or according to a clock timing from outside.

The hydraulic apparatus in accordance with the present invention may comprise a first energy accumulating device disposed on the output side of the check valve, a second control valve disposed in a pipeline branching off from a pipeline between the first energy accumulating device and the check valve, and a load disposed downstream thereof. This load is a hydraulic motor provided with a second energy accumulating device, and is driven by an operating fluid flowing therein from the hydraulic pump and first energy accumulating device when the second control valve is positioned on the pass side.

In another aspect, the present invention provides a hydraulic apparatus comprising a driving source inherently or additionally provided with a predetermined amount of inertia, a hydraulic pump driven by the driving source, an energy accumulating device and a second control valve both connected to a discharge side of the hydraulic pump, and a hydraulic motor connected downstream thereof; wherein a check valve having an input side directed to an operating fluid tank is connected between the second control valve and hydraulic motor; and wherein the second control valve is regulated so as to open/close when an amount of fluid required by the hydraulic motor is greater than an amount of fluid discharged by the hydraulic pump.

When employed in a vehicle, the hydraulic apparatus in accordance with the present invention comprises a first pump motor for driving a driving wheel of the vehicle, a third control valve connected so as to guide a discharge side of the first pump motor to an operating fluid tank, a check valve connected so as to direct an input side thereof to the discharge side of the first pump motor, a second control valve and a first energy accumulating device both connected to an output side of the check valve, a second pump motor connected to an output side of another check valve having an input side directed to the operating fluid tank on a downstream side of the second control valve, and a second energy accumulating device driven by the second pump motor; wherein the second energy accumulating device is accelerated by an operating fluid supplied from the first pump motor to the second pump motor by a kinetic energy of the vehicle upon switching between pass-side/stop-side positions of the second and third control valves.

In another aspect, the present invention provides a hydraulic apparatus applied to a vehicle, the hydraulic apparatus comprising a first pump motor for driving a driving wheel of the vehicle, a third control valve connected so as to be guided to a check valve and an operating fluid tank both having an input side thereof directed to a discharge side of the first pump motor, an energy accumulating device and a fourth control valve both connected to an output side of the check valve, a third pump motor connected to an output side of another check valve having an input side directed to the operating fluid tank on a downstream side of the fourth control valve, and a driving source for driving the third pump motor; wherein the driving wheel is decelerated by the driving source upon switching between pass-side/outside positions of the third and fourth control valves.

The above-mentioned object and other characteristic features and advantages of the present invention will be clear to those skilled in the art by reading the following detailed explanations with reference to the accompanying drawings.

BEST MODES FOR CARRYING OUT THE INVENTION

In the following, preferred embodiments of the present invention will be explained in detail with reference to the drawings.

Figure 1:
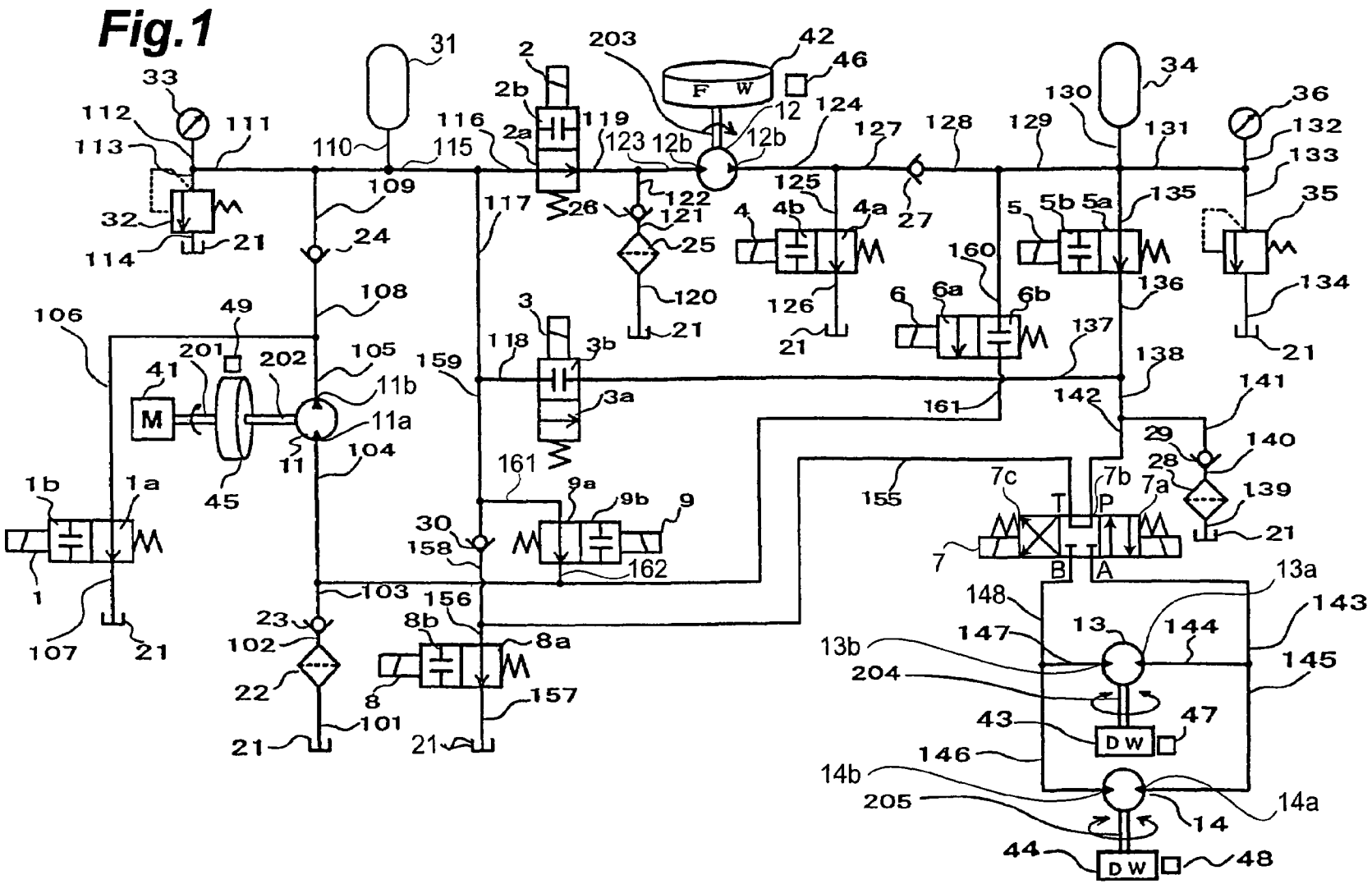
FIG. 1 is a hydraulic circuit diagram showing a hydraulic apparatus in accordance with the present invention employed as a driving system for a vehicle.

FIG. 1 is a hydraulic circuit diagram showing a hydraulic apparatus in accordance with the present invention employed in a driving system for a vehicle. In FIG. 1, number 41 refers to a driving source, which is preferably a heat engine in the vehicle, though other types of driving sources such as an electric motor may be used. An inertial element, which is specifically a flywheel 45, is attached to a shaft 201 of the driving source 41. The flywheel 45 is also known as a balance wheel, and accumulates a rotational energy when driven by the driving source 41 to rotate. A shaft 202 is connected to the center of the flywheel 45. By way of the shaft 201, the driving force from the driving source 41 is transmitted to a hydraulic pump ("third pump motor" in claims) 11 and drives the latter. When the driving source 41 has a large moment of inertia, i.e., when the driving source 41 is inherently provided with inertia, the flywheel 45 can be omitted. FIG. 1 shows the whole system of the hydraulic apparatus, organically combining a plurality of parts in charge of different functions and operations. In this embodiment, a hydraulic pump motor also functioning as a motor is used as the hydraulic pump 11.

By way of pipelines 101, 102, 103, 104, an operating fluid tank 21 is connected to an inlet port 11*a* of the hydraulic pump 11. A filter 22 for removing foreign matters from within an operating fluid is interposed between the pipelines 101 and 102. Disposed between the pipelines 102 and 103 is a check valve 23 having an input side directed to the operating fluid tank 21 and an output side directed to the hydraulic pump 11 via the pipeline 103 (i.e., so as to be able to inhibit the operating fluid from flowing from the pipeline 103 to the pipeline 102).

A pipeline 105 is connected to a discharge port 11*b* of the hydraulic pump 11, whereas a pipeline 106 branches off from the pipeline 10S. A pipeline 107 extending to the operating fluid tank 21 is connected to the pipeline 106 by way of a control valve ("first control valve" in claims) 1.

A pipeline 108 is connected to the pipeline 105, whereas the pipeline 108 is connected to a pipeline 109 by way of a check valve 24. The check valve 24 inhibits the operating fluid from flowing from the pipeline 109 to the pipeline 108. By way of a pipeline 110, an accumulator ("first energy accumulating device" in claims) 31 is connected to the pipeline 109.

A pipeline 111 branches off from between the pipelines 109 and 110. By way of a pipeline 112, a pressure sensor 33 is connected to the pipeline 111. The pressure sensor 33 can detect the pressure within the pipelines 109, 110 or the pressure accumulated in the accumulator 31. Pipelines 113, 114 having a relief valve 32 interposed therebetween are connected to the pipeline 111. The pipeline 114 communicates with the operating fluid tank 21. The relief valve 32 opens when the pressure on the output side of the check valve 24 becomes a predetermined value or higher, in order to prevent the pressure from exceeding the predetermined value.

A pipeline 115 branches off from between the pipelines 109 and 110, and is connected to a pipeline 116. By way of a control valve ("second control valve" in claims) 2, a pipeline 119 is connected to the pipeline 116. A pipeline 123 extends from the pipeline 119, and is connected to an inlet port 12*a* of a hydraulic motor ("second pump motor" in claims) 12. The hydraulic motor 12 functions as a load driven in response to the operating fluid discharged from the hydraulic pump 11. In this embodiment, a hydraulic pump motor also functioning as a pump is used as the hydraulic motor 12. A flywheel ("second energy accumulating device" in claims) 42 is attached to the rotary shaft of the hydraulic motor 12.

A pipeline 122 is connected to a junction between the pipelines 119 and 123. By way of pipelines 121, 120, the pipeline 122 communicates with the operating fluid tank 21. A filter 25 is interposed between the pipelines 121 and 120. A check valve 26 for stopping the flow from the pipeline 122 to the pipeline 121 is disposed between the pipelines 121 and 122.

A pipeline 124 is connected to an outlet port 12*b* of the hydraulic motor 12. A pipeline 125 branches off from the pipeline 124. By way of a control valve 4, a pipeline 126 extending to the operating fluid tank 21 is connected to the pipeline 125.

A pipeline 127 extends from the pipeline 124, whereas a pipeline 128 is connected to the pipeline 127 by way of a check valve 27. The check valve 27 inhibits the operating fluid from flowing from the pipeline 128 to the pipeline 127. A pipeline 129 extends from the pipeline 128. By way of a pipeline 130, an accumulator 34 is connected to the pipeline 129. The accumulator 34 functions as an energy accumulating device.

A pipeline 131 branches off from between the pipelines 129 and 130. By way of a pipeline 132, a pressure sensor 36 is connected to the pipeline 131. The pressure sensor 36 can detect the pressure within the pipelines 128, 130, 131 or the pressure accumulated in the accumulator 34. Pipelines 133, 134 having a relief valve 35 interposed therebetween are connected to the pipeline 131. The pipeline 134 communicates with the operating fluid tank 21. The relief valve 35 opens when the pressure on the output side of the check valve 27 becomes a predetermined value or higher, in order to prevent the pressure from exceeding the predetermined value.

A pipeline 135 branches off from the pipeline 129, whereas a pipeline 136 is connected to the pipeline 135 by way of a control valve 5. From the pipeline 136, pipelines 138, 142 extend to a control valve 7.

The control valve 7 is also known as a directional control valve, for which a 4-port, 3-position spool valve of solenoid type is used in the depicted embodiment. The pipeline 142 is connected to the P port of the control valve 7, whereas its T port communicates with the operating fluid tank 21 by way of pipelines 155, 156, 157. A control valve ("third control valve" in claims) 8 is interposed between the pipelines 156 and 157.

When the control valve 7 is at its center position 7*b*, the P and T ports communicate with each other, whereas the A and B ports are closed. When the control valve 7 is at the position 7*a*, the P port communicates with the A port, whereas the T port communicates with the B port. When the control valve 7 is at the position 7*c*, the P port communicates with the B port, whereas the T port communicates with the A port.

One port 13*a* of a bidirectional pump motor ("first pump motor" in claims) 13 is connected to the A port of the control valve 7 by way of pipelines 143 and 144, whereas the other port 13*b* of the pump motor 13 is connected to the B port of the control valve 7 by way of pipelines 148 and 147. A pipeline 145 is connected to the pipeline 143, whereas one port 14*a* of another bidirectional pump motor ("first pump motor" in claims) 14 is connected to the pipeline 145. A pipeline 146 is connected to the pipeline 148, whereas the other port 14*b* of the pump motor 14 is connected to the pipeline 146. Driving wheels 43, 44 of the vehicle are connected to respective rotary shafts of the pump motors 13, 14.

By way of the pipelines 117, 118, control valve 3, and pipeline 137 branching off from between the pipelines 115 and 116, an operating fluid can be supplied between the pipelines 136 and 138 between the control valves 5 and 7. A pipeline 159 is connected to the pipeline 117, and is connected to the pipeline 156 by way of a check valve 30 and a pipeline 158. The check valve 30 inhibits the operating fluid from flowing from the pipeline 159 to the pipeline 158.

A pipeline 141 is connected between the pipelines 138 and 142 between the control valves 5 and 7. By way of pipelines 140, 139, the pipeline 141 communicates with the operating fluid tank 21. A filter 28 is interposed between the pipelines 140 and 139. A check valve 29 for stopping the flow from the pipeline 141 to the pipeline 140 is disposed between the pipelines 140 and 141.

A pipeline 160 branches off from between the pipelines 128 and 129 between the hydraulic motor 12 and the control valve 5. By way of the control valve 6, the pipeline 160 is connected to a pipeline 161 communicating with the pipelines 103, 104 on the inlet side of the hydraulic pump 12. The pipelines 161 and 159 communicate with each other by way of pipelines 161, 162 having a control valve ("fourth control valve" in claims) 9 interposed therebetween.

Figure 2:
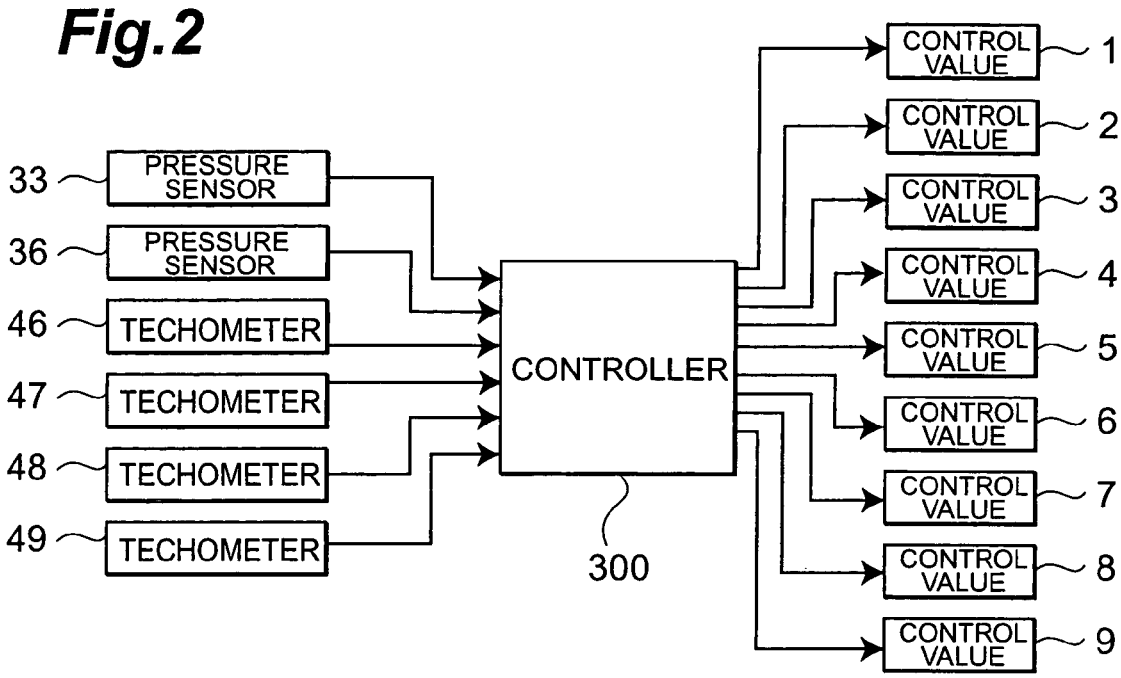
FIG. 2 is a schematic explanatory view showing a controller for regulating a control valve shown in FIG. 1, and its related elements.

The control valves 1 to 6, 8, and 9 are so-called solenoid type on/off valves, which are regulated together with the control valve 7 to open/close by a controller 300 constituted by a microcomputer and the like as shown in FIG. 2. Signals from pressure sensors 33, 36 are fed into the controller 300. Also fed into the controller 300 are signals from a tachometer 46 for detecting the number of revolutions of the flywheel 42, tachometers 47, 48 for detecting the respective numbers of revolutions of the driving wheels 43, 44, and a tachometer 49 for detecting the number of revolutions of the flywheel 45. The controller 300 is configured so as to regulate the opening/closing of the control valves 1 to 9 according to these signals.

Figure 3:
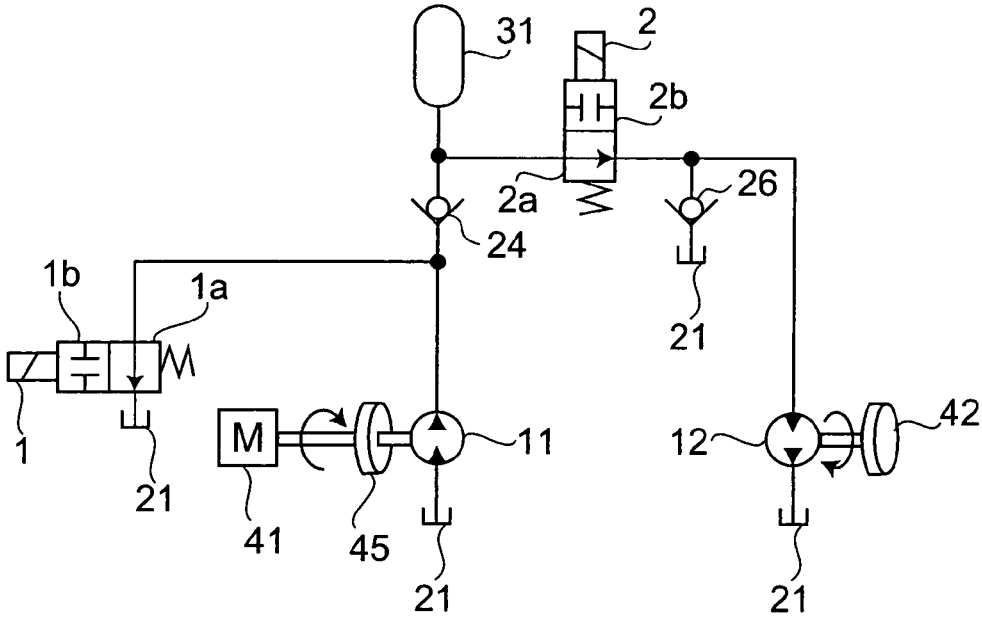
FIG. 3 is a hydraulic circuit diagram extracting a main circuit of FIG. 1.

In thus configured hydraulic apparatus, a case where the energy generated by driving the hydraulic pump 11 is accumulated into the accumulator 31 and flywheel 42 respectively acting as the first and second energy accumulating devices will now be explained. Reference will also be made to FIG. 3 extracting a part of the configuration of FIG. 1.

When the driving source 41 is started in the state shown in FIGS. 1 and 3, so as to drive the hydraulic pump 11 at a set number of revolutions, the operating fluid is inhaled from the operating fluid tank 21 into the hydraulic pump 11 by way of the pipeline 101, filter 22, pipeline 102, check valve 23, and pipeline 104. The operating fluid taken into the hydraulic pump 11 is discharged therefrom, so as to flow out of the pipeline 105 on the discharge side to the operating fluid tank 21 by way of the pipeline 106, the control valve 1 set onto the pass side 1*a*, and the pipeline 107. When the control valve 1 is positioned on the pass side 1*a*, the pipeline 106, control valve 1, and pipeline 107 form an unloaded flow path.

When the position of the control valve 1 is switched from the pass side 1*a* to the stop side 1*b* in this state, the hydraulic pump 11 driven by the driving source 41 causes the operating fluid to travel the pipelines 105, 108 and pass through the check valve 24 toward the load (i.e., toward the accumulator 31 and hydraulic motor 12). When the position of the control valve 1 is switched from the pass side 1*a* to the stop side 1*b*, a pressure higher than a discharge pressure which can be continuously generated by the hydraulic pump 11 driven at a set number of revolutions by the driving source 41, i.e., higher than a pressure discharged from the hydraulic pump 11 during its usual operation, is generated. When the control valves 2, 3, 9 are positioned on their stop sides 2*b*, 3*b*, 9*b*, this high-pressure operating fluid is supplied to the accumulator 31, whereby the energy is accumulated therein.

The reason why the high pressure is generated will now be explained in further detail. Letting Qm be the torque that can be generated by the driving source 41 constituted by a heat engine, an electric motor, or the like, and Qp be the torque of the hydraulic pump 11 driven by the driving source 41, it is clear that the relationship of $Qm=Qp$ holds when the loss is neglected. Assuming that I is the moment of inertia of the driving source 41 (which substantially equals the moment of inertia of the flywheel 45 since the moment of inertia of the driving source 41 itself is supposed to be small in the depicted embodiment), and $\omega$ be the angular velocity, the inertial torque required for accelerating or decelerating the driving source 41 can be represented by $I \cdot d\omega/dt$. Here, $I \cdot d\omega/dt$ attains positive and negative values at the time of acceleration and deceleration, respectively.

In this embodiment, the driving source 41 is regulated so as to keep its set number of revolutions when the control valve 1 is positioned on the pass side 1*a*. When the position of the control valve 1 is switched to the stop side 1*b*, the hydraulic pump 11 receives a load, whereby the driving source 41 is decelerated. Here, as mentioned above, the inertial torque of the driving source 41 (the inertial torque of the flywheel 45) $I \cdot d\omega/dt$ is added to Qm, whereby the relationship of $Qp=Qm-I \cdot d\omega/dt$ holds. Hence, with the inertial torque caused by the deceleration of the driving source 41 being added, a torque greater than the input torque Qm of the hydraulic pump 11 at the time of usual operation is fed into the hydraulic pump 11. On the other hand, the discharge pressure of the hydraulic pump 11 increases along with the load pressure. As a result, the operating fluid with an increased pressure is supplied to the load on the downstream side.

Though the foregoing explanation only relates to a case where the operation of switching the position of the control valve 1 from the pass side 1*a* to the stop side 1*b* is carried out only once, the operation (switching operation) of switching from the stop side 1*b* to the pass side 1*a* and then to the stop side 1*b* again may be repeated, whereby the operating fluid having a high pressure as mentioned above can continuously be supplied to the load.

This embodiment can supply a high hydraulic pressure by a smaller driving source as such, whereby a load can be driven without providing a driving source having an output torque corresponding to the maximum load torque needed by the load, which has a great merit in terms of economy as well. The maximum pressure that can be generated can be set by the moment of inertia I of the driving source 41 and the magnitude of angular acceleration dω/dt.

In the following manner, the switching operation of the control valve 1 is carried out. In FIG. 1, the flywheel 45 is provided with the tachometer 49, and the number of revolutions of the driving source 41 is detected by the tachometer 49. Therefore, it can be recognized from a detection signal from the tachometer 49 if the load torque of the hydraulic pump 11 exceeds the output torque of the driving source 41 and thereby the number of revolutions of the driving source 41 is reduced to the lower limit. The controller 300 receives the signal from the tachometer 49. If the signal indicates that the number of revolutions of the driving source 41 is not higher than the lower limit, the controller 300 sends a control signal to the control valve 1, so as to switch it from the stop side 1*b* to the pass side 1*a*, thereby yielding an unloaded state, i.e., a state where the load of the hydraulic pump 11 is removed. As a result, the load torque exerted on the driving source 41 decreases, and its number of revolutions gradually increases to the upper limit or higher. Here, the controller 300 switches the position of the control valve 1 to the stop side 1*b* again. The timing for this switching operation is not limited to the instant when the number of revolutions reaches the upper limit, but may be immediately thereafter or immediately therebefore in expectation that the number of revolutions reaches the upper limit. As such, the control valve 1 repeatedly executes switching operations, thereby continuing its self-exciting action. The rate of change in the number of revolutions of the hydraulic pump 11, i.e., change in the amount of discharge of the operating fluid, depends on the moment of inertia of the hydraulic pump 11 about its axis.

The pressure sensor 33 measures the pressure state on the output side of the check valve 24. Therefore, upon recognizing that the value measured by the pressure sensor 33 reaches a predetermined set value according to the signal therefrom, the controller 300 switches the position of the control valve 1 from the stop side 1*b* to the pass side 1*a*, thereby returning the operating fluid discharged from the hydraulic pump 11 to the operating fluid tank 21. This operation places the driving source 41 into an unloaded state, and increases its number of revolutions. Detecting means used for determining the switching timing as such may be not only the pressure sensor 33 and tachometer 49, but also sensors for monitoring the state of load. When the switching timing is known beforehand, etc., the switching can be carried out according to clock timings from outside without monitoring the state.

When the position of the control valve 2 is switched to the pass side 2*a*, the operating fluid discharged from the hydraulic pump 11 driven by the driving source 41 and the operating fluid from the accumulator 31 acting as an energy accumulating device flow into the hydraulic motor 12 acting as a load, and then return from the pipeline 124 on the discharge side to the operating fluid tank 21 by way of the pipeline 125, the control valve 4 positioned on the pass side 4*a*, and the pipeline 126. This operation drives the hydraulic motor 12, so that the flywheel 42 starts rotating and is accelerated. This makes the flywheel 42 accumulate energy.

Disposed between the control valve 2 and the hydraulic motor 12 are the pipelines 120, 121, 122 provided with the check valve 26 connected so as to direct its input side to the operating fluid tank 21. The reason therefor will be explained with reference to FIG. 3. When the number of revolutions of the hydraulic motor 12 increases such that the amount of fluid needed by the hydraulic motor 12 is greater than the amount of fluid discharged by the hydraulic pump 11, the hydraulic motor 12 cannot be accelerated anymore.

Here, the position of the control valve 2 is switched from the pass side 2*a* to the stop side 2*b*. This operation makes the accumulator 31 accumulate the operating fluid, and places the hydraulic motor 12 into a freewheeling state since the operating fluid supplied thereto is not obstructed by the check valve 26. When a predetermined amount of operating fluid is accumulated in the accumulator 31, the position of the control valve 2 is switched to the pass side 2*a* again, whereby the operating fluid accumulated in the accumulator 31 flows into and accelerates the hydraulic motor 12. Repeating the switching operation of the control valve 2 as such can intermittently accelerate the hydraulic motor 12 even when the amount of fluid needed thereby is greater than the amount of fluid discharged from the hydraulic pump 11. Therefore, a large amount of flow having a low average pressure for acceleration can be supplied to the hydraulic motor 12 as a load.

Figure 4:
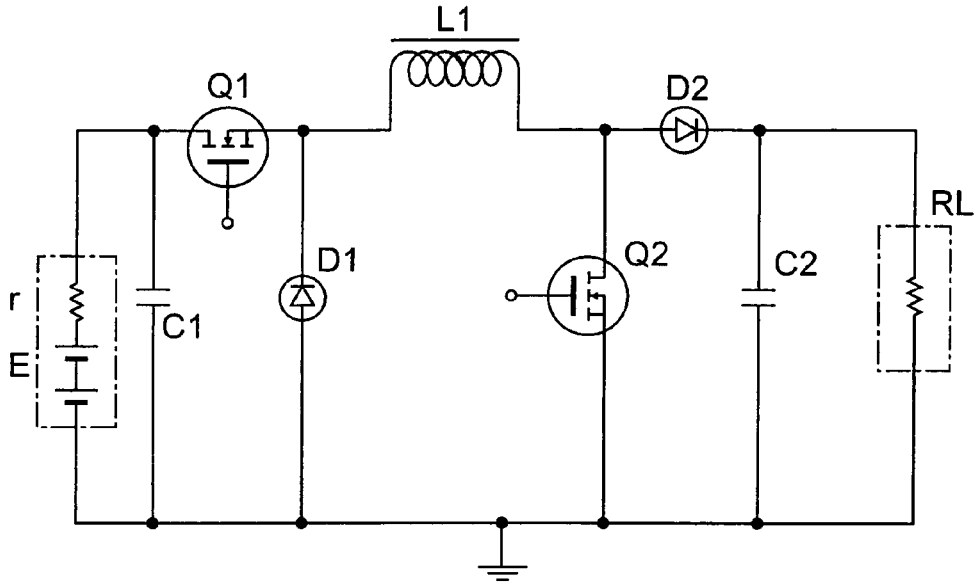
FIG. 4 is an electric circuit diagram showing an electric circuit substantially equivalent to the hydraulic circuit diagram of FIG. 3.

FIG. 4 shows an electric circuit substantially equivalent to the hydraulic circuit of FIG. 3. In FIG. 4, E is a power supply, RL is a load, C1 and C2 are capacitors, Q1 and Q2 are switching devices such as transistors, D1 and D2 are rectifiers, and L1 is an inductor. The power supply E corresponds to the hydraulic pump 11, whereas the load RL corresponds to the hydraulic motor 12. The capacitor C1 is the inertia (flywheel 45) of the hydraulic pump 11, whereas the capacitor C2 is the inertia (flywheel 42) of the hydraulic pump 12. The switching devices Q1 and Q2 correspond to the control valves 2 and 1, respectively. The rectifiers D1 and D2 correspond to the check valves 26 and 24, respectively. The inductor L1 corresponds to the accumulator 31. The electric circuit shown in FIG. 4 is known as a switching power control circuit or power regulator circuit, which can adjust the voltage of the load RL by regulating switching frequencies of the switching devices Q1 and Q2.

It will be understood that the hydraulic circuit of FIG. 3 substantially equivalent to the electric circuit of FIG. 4 operates similarly thereto, and can adjust the number of revolutions of the rotary shaft of the hydraulic motor 12 corresponding to the load RL so as to make it fall within a predetermined range by regulating the switching of positions of the control valves 1, 2.

Figure 5:
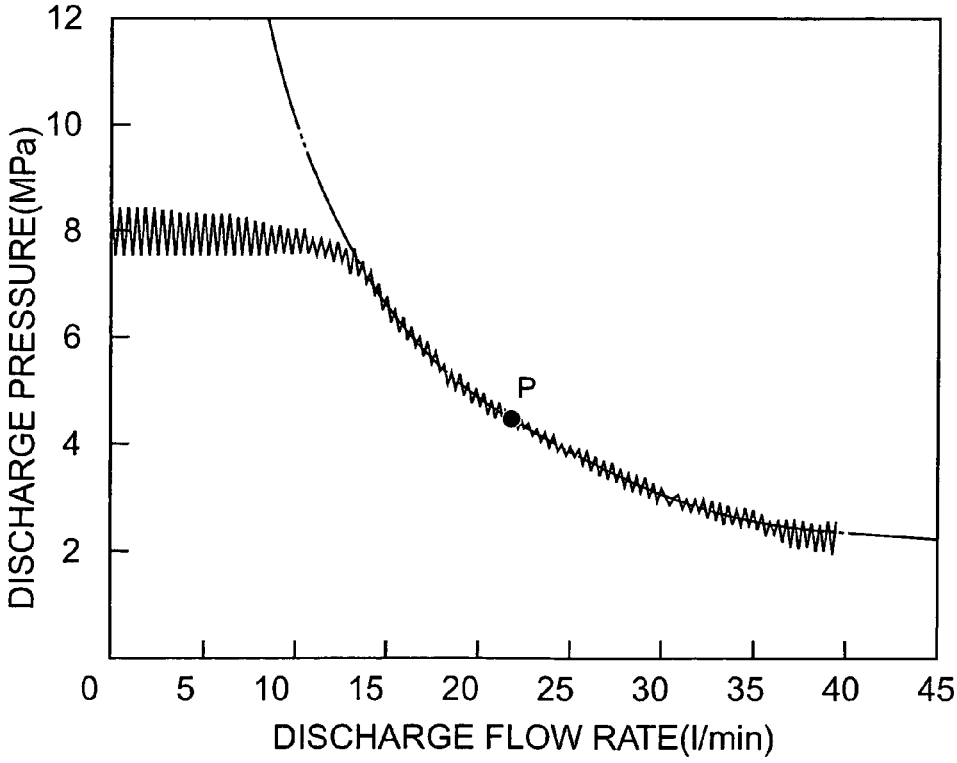
FIG. 5 is a graph showing a P-Q characteristic in the hydraulic circuit configured as shown in FIG. 3.

FIG. 5 shows an example of results of experiments obtained by using an experimental apparatus constructed in conformity to the hydraulic circuit of FIG. 3. In FIG. 5, the solid curve passing the point P indicates the result of an experiment obtained when the amount of discharge was changed while the input was fixed to that in the case where the hydraulic pump 11 had a discharge rate of 21.75 liters/min and a discharge pressure of 4.5 MPa. This curve is seen to indicate an ideal variable discharge pump characteristic as compared with the dash-double-dot curve representing theoretical values. Namely, this chart illustrates that the load can efficiently be supplied with the operating fluid ranging from a low flow rate with a high pressure to a high flow rate with a low pressure.

A case where the hydraulic apparatus configured as mentioned above is used for starting and accelerating a vehicle will now be explained. The starting is just a case where the initial speed to be accelerated is zero, and thus will be explained simply as acceleration in the following. The acceleration of the vehicle includes three methods, i.e., one using the driving source 41 alone, one using only the flywheel 42 operating at a preset number of revolutions, and one using both the driving source 41 and the flywheel 42.

When accelerating the vehicle with the driving source 41 alone, the control valves 2, 5, 6, 9 are set to their close positions or on the stop sides 2*b*, 5*b*, 6*b*, 9*b*, whereas the control valve 8 is set to its open position or on the pass side Ba. On the other hand, the control valve 7 is switched from the center position 7*b* to the position 7*a*.

Thereafter, the operating fluid discharged from the hydraulic pump 11 driven by the driving source 41 is supplied to the pump motors 13, 14, so as to accelerate rotations of the rotary shafts of the pump motors 13, 14, and rotations of the driving wheels 43, 44. There are also three methods in this case. The first method fixes the position of the control valve 3 to the pass side 3*a*, and repeatedly switches the control valve 1 between the pass side 1*a* and stop side 1*b* according to circumstances. The second method fixes the control valve 1 to the stop side 1*b*, and repeatedly switches the control valve 3 between the pass side 3*a* and stop side 3*b* according to circumstances. The third method switches between positions of both the control valves 1, 3 as required. The control valve 5 may switch its positions according to circumstances. Acceleration can also be achieved when an undepicted control valve is disposed in the pipeline 138 and operated in a manner similar to that mentioned above.

Here, note that the control valve 3 corresponds to the control valve 2, the check valve 29 to the check valve 26, the control valve 8 to the control valve 4, and the pump motors 13, 14 to the hydraulic motor 12. The driving wheels 43, 44 also function as inertial elements which can be driven by the inertia of the vehicle. Since the switching operations of the control valves 1, 3, 8 are equivalent to those of the control valves 1, 2, 4 mentioned above, their overlapping explanations will be omitted.

When accelerated by the flywheel 42 alone, it is necessary for the flywheel 42 to operate at a number of revolutions falling within a preset range. The flywheel 42 operating within the preset range becomes the driving side. Therefore, the control operation for accelerating the driving wheels 43, 44 of the vehicle on the driven side is carried out in a state where at least the control valves 3, 6, 9 are positioned on their stop sides 3*b*, 6*b*, 9*b*. Then, the positions of the control valves 4, 5, 8 are switched, so as to supply the pump motors 13, 14 with the operating fluid. There are also three methods in this case. In the first method, while the control valve 8 is positioned on the pass side 8*a*, the control valve 5 is fixed to the position on the pass side 5*a*, and the position of the control valve 4 is repeatedly switched between pass side 4*a* and the stop side 4*b* according to circumstances. The second method fixes the control valve 4 to the position on the stop side 4*b*, and repeatedly switches between positions of the control valve 5. The third method repeatedly switches between positions of both the control valves 4, 5.

Here, note that the hydraulic motor 12, control valve 4, check valve 27, accumulator 34, control valve 5, check valve 29, pump motors 13, 14, and control valve 8 correspond to the hydraulic motor 11, control valve 1, check valve 24, accumulator 31, control valve 2, check valve 26, hydraulic motor 12, and control valve 4, respectively.

The vehicle can also be accelerated by both the driving source 41 and flywheel 42 if the control valves are repeatedly switched according to circumstances as mentioned above.

The switching operation according to circumstances will now be explained. The amount of operating fluid varies depending on the speed of the vehicle, but can be determined by detecting states such as numbers of revolutions of the pump motors 13, 14 on the driven side. Similarly, the amount of fluid that can be supplied can be determined by detecting the number of revolutions of the pump motor 13 or 14 on the driving side and the like. Means for detecting the state of rotation are the tachometer 46 attached to the flywheel 42, the tachometers 47, 48 attached to the pump motors 13, 14, and the tachometer 49 attached to the flywheel 45. Means for detecting the state of the operating fluid are the pressure sensors 33, 36. In response to signals from these sensors, the controller 300 causes the control valves to carry out switching operations. Flow rates can also be measured by flow rate sensors and the like.

For example, the controller 300 switches the position of the control valve 4 to the pass side 4*a* upon recognizing that the sensor 36 reaches a preset upper pressure, and switches the position of the control valve 4 to the stop side 4*b* again when the sensor 36 reaches a preset lower pressure, thus carrying out acceleration by repeating this switching operation. Changing the upper and lower pressure limits as such can regulate the degree of acceleration. In the case where the states on the driving side and driven side are grasped beforehand, control valves can be switched by control signals and clocks outputted from the controller 300 as well.

Though the operating fluid for accelerating the vehicle includes the part passing the control valve 3 from the hydraulic pump 11 and the part from the hydraulic motor 12, the part accumulated in the accumulator 34 can also be used. Namely, while in a state where the flywheel 42 attached to the hydraulic motor 12 is rotating, the hydraulic motor 12 can operate as a hydraulic pump, so as to cause the accumulator 34 to accumulate the operating fluid from the operating fluid tank 21, and thus accumulated hydraulic fluid can be used for accelerating rotations of the rotary shafts of the pump motors 13, 14. The operating fluid passed through the pump motors 13, 14 is returned to the operating fluid tank 21 by way of the control valve 8.

A case where the vehicle is decelerated while in an advancing state will now be explained. The deceleration includes two patterns, i.e., a decelerating operation accompanying regeneration and a decelerating operation without regeneration. First, the decelerating operation with regeneration will be explained. When the vehicle advances, the ports 13*b*, 14*b* of the pump motors 13, 14 become the discharge side. The pipeline 158 on the input side of the check valve 30 is connected to the pipeline 155 connected to the ports 13*b*, 14*b* by way of the control valve 7 at the position 7*a*, whereas the output side of the check valve 30 is connected to the input side of the control valve 2. In this configuration, in a state where the pump motors 13, 14 continue their revolutions because of the inertia of the vehicle, the pump motors 13, 14 become the driving side, whereas the driven side is the hydraulic motor 12 to which the flywheel 42 is connected. When accelerated, the flywheel 42 becomes a load, thereby decelerating the vehicle. The control operation can be explained as in the case of accelerating the vehicle with the flywheel 42, in which actions similar thereto are carried out while the control valves 5 and 4 to switch their positions act as the control valves (second and third control valves) 2 and 8, respectively.

Figure 6:
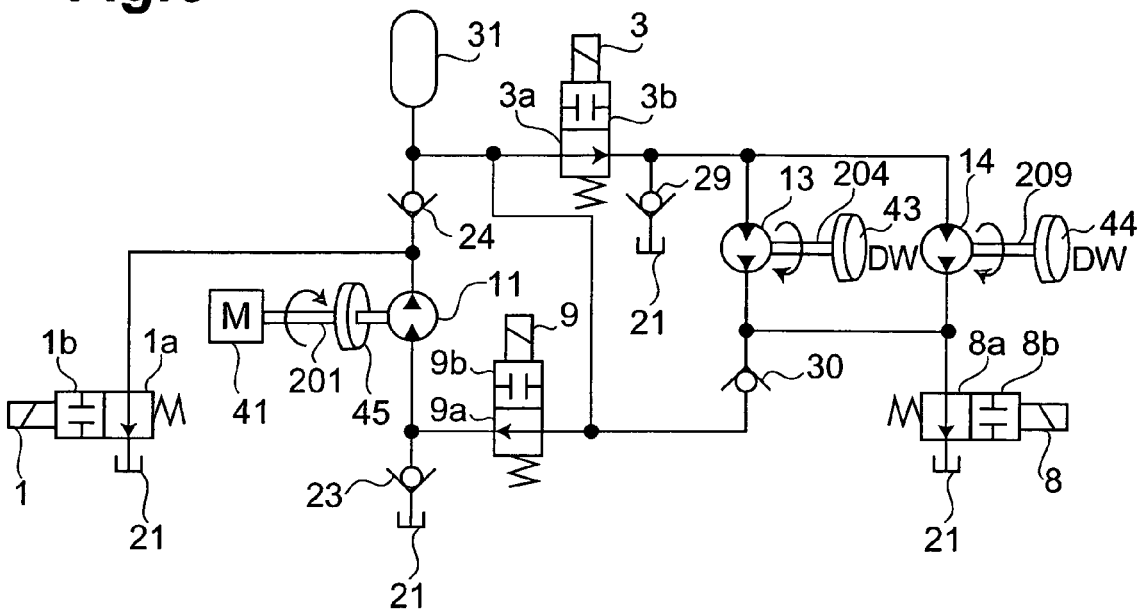
FIG. 6 is a hydraulic pressure circuit diagram extracting from FIG. 1 a configuration for applying the present invention to decelerating a vehicle.

The decelerating operation without regeneration will now be explained. From FIG. 1, FIG. 6 extracts a circuit configuration required for deceleration without regenerating a kinetic energy of the vehicle. Actions in this configuration will now be explained. When the vehicle is decelerated, the operating fluid discharged from the pump motors 13, 14 flows into the hydraulic pump 11 acting as a motor. The hydraulic pump 11 is linked to the driving source 41 and thus acts as a so-called engine brake, thereby decelerating the vehicle. The control operation can be explained as in the case of accelerating the vehicle with the flywheel 42, in which actions similar thereto are carried out while the control valves 5 and 4 to switch their positions act as the control valves 9 and 8, respectively.

The regenerating action at the time of decelerating the vehicle can be carried out by energy accumulating devices such as accumulators and flywheels mentioned above. Even when regeneration is not necessary in particular, the operating fluid discharged from the pump motors 13, 14 flows into the hydraulic pump 11, so that the driving source 41 having the hydraulic pump 11 linked thereto becomes a load and consumes energy, whereby deceleration can be achieved without consuming the energy as thermal energy by relief valves and the like. This can prevent the operating fluid from raising its temperature and deteriorating.

For moving the vehicle in reverse, it will be sufficient if the position of the control valve 7 is switched to the position 7*b*.

For coasting the vehicle, if the position of the control valve 8 is switched to the pass side 8*a* while at least the control valves 3, 5, 6 are positioned on their stop sides 3*b*, 5*b*, 6*b*, the pipelines 139, 140, 141 connected between the pipelines 138, 142 construct a freewheeling circuit of the pump motors 13, 14, whereby the operating fluid returns to the operating fluid tank 21 by way of the control valves 7, 8. Under this condition, the vehicle attains a coasting state. As the control valve 7, one different from the type shown in FIG. 1 may be used, so as to construct pipeline parts for the pump motors 13, 14 as a closed circuit, thereby achieving a coasting state.

When the flywheel 42 is operating at a preset number of revolutions, the control valve 6 can be opened and closed, so as to supply the hydraulic pump 11 with the operating fluid from the hydraulic motor 12, thereby starting the driving source 41, etc.

In the present invention, the pump motors 11 to 14 can be pumps with fixed discharge amounts. This enables reversible actions which cannot be realized by pumps with variable discharge amounts, thereby making it possible to utilize engine braking effects of motors on the driving side.

Though preferred embodiments of the present invention are explained in detail in the foregoing, the present invention is not limited to the above-mentioned embodiments, and elements satisfying functions required in the present invention can be used as a replacement. The system employing the hydraulic apparatus in accordance with the present invention is not limited to the vehicle.

INDUSTRIAL APPLICABILITY

By switching the control valves according to the load required, the present invention can efficiently supply the load with the operating fluid discharged from a fixed pressure hydraulic source ranging from a low flow rate at a high pressure to a high flow rate at a low pressure, whereby a heat engine, an electric motor, or the like acting as a driving source can be used in the vicinity of its most efficient number of revolutions. Also, the driven hydraulic pump can always be operated at a highly efficient number of revolutions regardless of types such as whether it is a fixed or variable discharge pump. Therefore, conventional devices can efficiently be operated, whereby the system as a whole can attain a higher efficiency.

Also, in this operation, the energy discarded as an excess in conventional fixed discharge pumps will not be lost, so that the operating fluid can be prevented from raising its temperature and deteriorating, whereby actions as a variable discharge pump can be realized without changing the capacity by a pump. Therefore, a fixed discharge pump can realize the same function as that of a variable discharge pump without using any expensive variable discharge pump.

When used as a driving apparatus for a vehicle or the like, the hydraulic apparatus of the present invention can collect a kinetic energy of the traveling vehicle or the like, so as to realize regenerative braking, or cause the motor acting as a driving source to function as an engine brake, thus allowing pump motors to effect reversible actions, whereby operations with a high efficiency are possible. When there is no regeneration, the operating fluid can be prevented from raising its temperature.

The invention claimed is:

1. A hydraulic apparatus comprising:

an operating fluid tank;

a driving source inherently or additionally provided with a predetermined amount of inertia;

a hydraulic pump driven by the driving source, said pump adapted to suck in the operating fluid from said tank;

a first pipeline extending the discharge port of said hydraulic pump toward a load;

a second pipeline branching off from said first pipeline and extending to said tank;

a first open/close valve interposed in said second pipeline; and a check valve interposed in said first pipeline on a downstream side of a branching point between said first and second pipelines, said check valve adapted to flow the fluid in only one direction from said hydraulic pump toward said load, wherein pressure of the fluid is raised by said inertia and the fluid is supplied to said load when the position of said first open/close valve is repeatedly switched between a pass side and a stop side thereof.

2. A hydraulic apparatus according to claim 1, wherein an operation of switching the position of said first open/close valve between the stop side and the pass side is carried out according to a value of detecting means for detecting a state of a driving system or load system connected to said hydraulic apparatus.

3. A hydraulic apparatus according to claim 1, wherein an operation of switching the position of said first open/close valve between the stop side and the pass side is carried out according to a clock timing from outside.

4. A hydraulic apparatus according to claim 1, wherein the position of said first open/close valve is switched to the pass side when said hydraulic pump attains a load torque reaching a value exceeding an output torque of said driving source and a number of revolutions lowered to a lower limit; and wherein the position of said first open/close valve is switched to the stop side after the number of revolutions of said hydraulic pump increases to an upper limit as the load torque of said hydraulic pump decreases.

5. A hydraulic apparatus according to claim 4, wherein an operation of switching the position of said first open/close valve between the stop side and the pass side is carried out according to a value of detecting means for detecting a state of a driving system or load system connected to said hydraulic apparatus.

6. A hydraulic apparatus according to claim 4, wherein an operation of switching the position of said first open/close valve between the stop side and the pass side is carried out according to a clock timing from outside.

7. A hydraulic apparatus according to one of claims 1, 2, 3, 4, 5 and 6, wherein said hydraulic pump is a pump with a fixed discharge amount.

8. A hydraulic apparatus according to one of claims 1, 2, 3, 4, 5 and 6, comprising:

a first energy accumulating device interposed in said first pipeline on the output side of said check valve; and a second open/close valve interposed in said first pipeline downstream of said first energy accumulating device;

wherein said load is driven by the fluid flowing therein from said hydraulic pump and said first energy accumulating device when said second open/close valve is positioned on a pass side thereof.

9. A hydraulic apparatus according to claim 8, wherein said load is a hydraulic motor provided with a second energy accumulating device.

10. A hydraulic apparatus according to claim 9, wherein the second energy accumulating device is a flywheel attached to the hydraulic motor.

11. A hydraulic apparatus comprising:

an operating fluid tank;

a driving source inherently or additionally provided with a predetermined amount of inertia;

a hydraulic pump driven by the driving source, said pump adapted to suck in the operating fluid from said tank;

a hydraulic motor;

a first pipeline extending the discharge port of said hydraulic pump toward said hydraulic motor;

an energy accumulating device connected to said first pipeline;

an open/close valve interposed in said first pipeline downstream of said energy accumulating device;

a second pipeline branching off from said first pipeline between said hydraulic motor and said open/close valve and extending to said tank; and a check valve interposed in said second pipeline, said check valve adapted to flow the fluid in only one direction from said tank toward said hydraulic motor, wherein the switching operation of said open/close valve that the position of said open/close valve is switched to a stop side when an amount of fluid required by the hydraulic motor is greater than an amount of fluid discharged by the hydraulic pump and that the position of said open/close valve is switched to a pass side when the fluid is accumulated in said energy accumulating device is repeated.

12. A hydraulic apparatus for use in a driving system of a vehicle, said apparatus comprising:

an operating fluid tank (21);

a first pump motor (13 or 14) for driving a driving wheel (43 or 44);

a first pipeline (155, 156, 157) for leading the operating fluid discharged from said first pump motor toward said tank;

a first open/close valve (8) interposed in said first pipeline;

a second pump motor (12);

a second pipeline (158, 159, 117, 116, 119, 123) branching off from said first pipeline between said first pump motor and said first open/close valve and extending to an inlet port of said second pump motor;

a first check valve (30) interposed in said second pipeline, said first check valve adapted to flow the fluid in only one direction from said first pump motor toward said second pump motor;

a first energy accumulating device (31) connected to said second pipeline between said first check valve and said second pump motor;

a second open/close valve (2) interposed in said second pipeline between said first energy accumulating device and said second pump motor;

a second energy accumulating device (42) adapted to be driven by said second pump motor;

a third pipeline (122, 121, 120) branching off from said second pipeline between said second pump motor and said second open/close valve and extending to said tank; and a second check valve (26) interposed in said third pipeline, said second check valve adapted to flow the fluid in only one direction from said tank toward said second pump motor, wherein the fluid discharged from said first pump motor by a kinetic energy of said driving wheel is supplied to said second pump motor to accumulate energy in said second energy accumulating device upon repeatedly switching between a pass side position and a stop side position of said first open/close valve and/or said second open/close valve.

13. A hydraulic apparatus for use in a driving system of a vehicle, said apparatus comprising:

an operating fluid tank (21);

a first pump motor (13 or 14) for driving a driving wheel (43 or 44);

a first pipeline (155, 156, 157) for leading the operating fluid discharged from said first pump motor toward said tank;

a first open/close valve (8) interposed in said first pipeline;

a second pump motor (11);

a second pipeline (158, 161, 162, 104) branching off from said first pipeline between said first pump motor and said first open/close valve and extending to an inlet port of said second pump motor;

a check valve (30) interposed in said second pipeline, said check valve adapted to flow the fluid in only one direction from said first pump motor toward said second pump motor;

an energy accumulating device (31) connected to said second pipeline between said check valve and said second pump motor;

a second open/close valve (9) interposed in said second pipeline between said energy accumulating device and said second pump motor; and a driving source (41) for driving said second pump motor, wherein said driving wheel is decelerated as a load upon repeatedly switching between a pass side position and a stop side position of said first open/close valve and/or said second open/close valve.

* * * * *